United States Patent [19]

Singer et al.

[11] 4,139,444

[45] Feb. 13, 1979

[54] METHOD OF RETICULATING A PYROELECTRIC VIDICON TARGET

[75] Inventors: Barry M. Singer, New York; Yannick J. Thefaine, Beacon, both of N.Y.

[73] Assignee: North American Philips Corporation, New York, N.Y.

[21] Appl. No.: 859,542

[22] Filed: Dec. 12, 1977

[51] Int. Cl.[2] ..... C23C 15/00

[52] U.S. Cl. ..... 204/192 E; 313/388; 156/656; 156/657

[58] Field of Search ..... 204/192 E, 192 EC; 156/643, 654, 656, 657, 667, 668; 313/388

[56] References Cited

U.S. PATENT DOCUMENTS

| | | | |
|---|---|---|---|
| 4,019,084 | 4/1977 | Conklin et al. | 313/388 |
| 4,053,806 | 10/1977 | Turnbull et al. | 313/388 |

*Primary Examiner*—John H. Mack
*Assistant Examiner*—Aaron Weisstuch
*Attorney, Agent, or Firm*—Carl P. Steinhauser

[57] ABSTRACT

A method of fabricating a pyroelectric vidicon target wherein a layer of pyroelectric material is attached to a substrate, reduced in thickness, reticulated, covered with an electron permeable support layer, removed from the substrate, and covered with a layer of silicon oxide on the side scanned by the electron beam.

6 Claims, 3 Drawing Figures

METHOD OF RETICULATING A PYROELECTRIC VIDICON TARGET

This invention was made under contract with the U.S. Government DAAG 53-76-C-0053.

This invention relates to a pyroelectric vidicon target and in particular to a method of manufacture thereof.

BACKGROUND OF THE INVENTION

In order to increase resolution with a pyroelectric vidicon it has been proposed to reticulate the target to form a plurality of relatively isolated areas. A technique for reticulating a layer of pyroelectric material for this purpose has been described in application Ser. No. 748,640, filed Dec. 8, 1976, now abandoned, which is incorporated herein by reference.

An object of the present invention is to provide an improved process for reticulating a layer of pyroelectric material for use as a target in a pyroelectric vidicon to obtain improved resolution and picture quality.

A further object of this invention is to provide a process having an improved yield of targets suitable for use in a pyroelectric vidicon.

SUMMARY OF THE INVENTION

In accordance with this invention, the layer of pyroelectric material is first bonded to a substrate, usually glass. After bonding, the layer of pyroelectric material is reduced in thickness either by chemical or plasma etching techniques to a thickness of about 20$\mu$. Then a mask is placed over the exposed surface of the layer of pyroelectric material and the exposed areas etched further to reticulate the layer. The mask is then removed and a polymer layer thin enough to be pervious to electrons is placed over the reticulated layer. Finally, the reticulated layer is separated from the substrate and is ready for further processing before mounting in an evacuated envelope.

In order to ensure electrical contact to the reticulated layer, the exposed surface is covered with a very thin layer of antimony which is pervious to infra-red radiation.

In addition, the polymer layer which supports the reticulated layer, and which faces the electron beam is coated with a thin layer of silicon oxide ($SiO_x$, $1 < x < 2$) which is slightly conductive allowing excess charge to leak off.

The invention will be described in connection with the accompanying drawing in which.

DETAILED DESCRIPTION OF THE INVENTION

Figures 1, 2, 3:
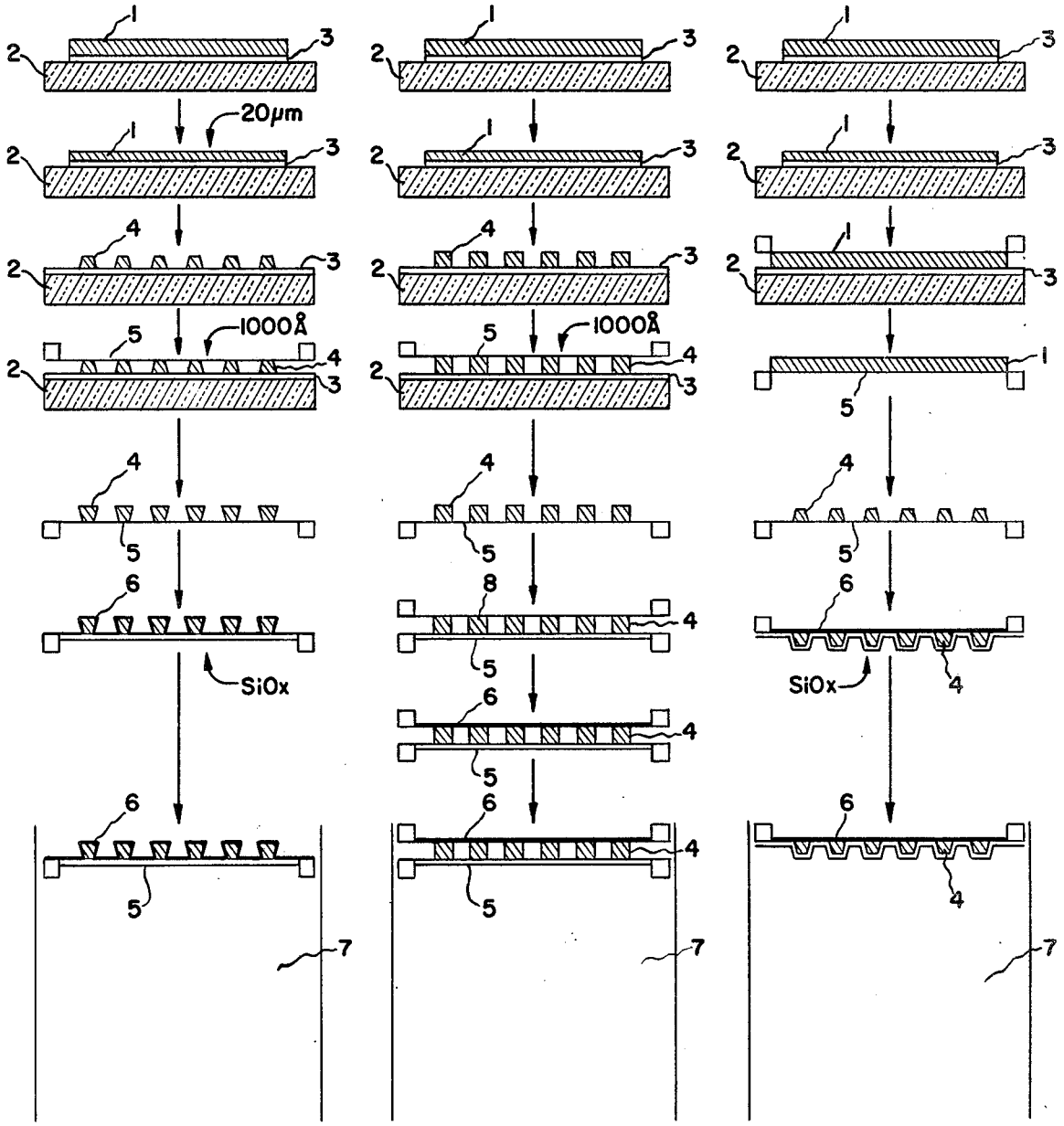
FIG. 1 is a flow diagram showing stages in the fabrication of a target.
FIG. 2 is a flow diagram showing stages in alternative method for the fabrication of a target.
FIG. 3 is a flow diagram showing the present process for making a target for a pyroelectric vidicon target.

In accordance with the present invention, a layer of pyroelectric material 1, e.g. tri-glycine sulfate, tri-glycine fluoroberyllate, or deuterated tri-glycine fluoroberyllate, is bonded to a glass substrate 2 by a layer of molten and then solidified wax 3 (FIGS. 1 and 2). Thereafter, the layer of pyroelectric material 1 is reduced in thickness to about 20 $\mu$m by etching, chemical or plasma. Following this step, a mask (not shown) is placed over the exposed surface of the pyroelectric material and etching continued to form islands 4, (shown exaggerated). The mask is removed and a layer 5 of polymer, e.g. polyvinylchloride, of sufficient thickness to support the reticulated layer 4, but thin enough to be electron pervious is formed over the reticulated layer.

The reticulated layer 4 is then separated from the substrate 2 and is ready for further processing.

As shown in FIG. 1, a thin layer of antimony 6 is deposited over the exposed surface of the reticulated layer, the purpose of which is to provide an electrical contact with the layer when mounted in the tube. Moreover, the antimony layer must be thin enough to be pervious to infra-red radiation. Deposition of such layers has been described in the prior art and does not form part of this invention.

A layer of silicon oxide ($SiO_x$, $1 < x < 2$) is deposited on the polymer layer which is now ready to be mounted in the tube 7. The deposition of such layers is described in U.S. Pat. No. 4,019,084.

In an alternative embodiment (see FIG. 2) the pyroelectric material is removed by sputtering. In this case, the exposed surface of the pyroelectric material is covered with a polymer layer 8 and after further processing is mounted in the tube with the sputtered side facing the electron beam.

By way of comparison, FIG. 3 shows the present process as described in application Ser. No. 748,640, filed Dec. 8, 1976. The process according to the invention affords the advantage of improved target yield.

What is claimed is:

1. In the manufacture of a target for a pyroelectric vidicon, the steps of attaching a layer of pyroelectric target material to a support substrate, reducing the thickness of said layer to about 20 $\mu$m, etching through a mask to thereby reticulate the target, forming an electron-pervious polymer layer over said layer of reticulated pyroelectric material, and removing the layer of reticulated pyroelectric material from said support substrate.

2. A method of manufacturing a target for a pyroelectric vidicon as claimed in claim 1 in which the surface of the electron pervious polymer layer opposite the layer of reticulated pyroelectric material is covered with silicon oxide.

3. A method of manufacturing a target for a pyroelectric vidicon as claimed in claim 2 wherein the exposed surface of the reticulated pyroelectric material formed by said substrate removal step is covered with an electron pervious layer of antimony.

4. A method of manufacturing a pyroelectric vidicon target as claimed in claim 1 in which the exposed surface of the reticulated target formed by said substrate removal step is covered with a polymer layer of the same thickness as the electron pervious polymer layer.

5. A method of manufacturing a pyroelectric vidicon target as claimed in claim 4 in which the layer of pyroelectric material is bonded to the substrate by adhesive means and is partly removed by sputtering.

6. A method of manufacturing a pyroelectric vidicon target as claimed in claim 1 in which the pyroelectric material is tri-glycine sulfate, tri-glycine fluoroberylliate, or deuterated tri-glycine fluoroberylliate.

* * * * *